United States Patent [19]

Geney

[11] Patent Number: 4,461,212

[45] Date of Patent: Jul. 24, 1984

[54] DRIVE AND PRINTING MECHANISM FOR A FRANKING MACHINE

[75] Inventor: Christian Geney, Clichy, France

[73] Assignee: SMH Alcatel, Paris, France

[21] Appl. No.: 449,342

[22] Filed: Dec. 13, 1982

[30] Foreign Application Priority Data

Jan. 12, 1982 [FR] France ..... 82 00343

[51] Int. Cl.[3] ..... B41F 13/34

[52] U.S. Cl. ..... 101/407 R; 101/232; 101/234; 271/274; 400/56

[58] Field of Search ..... 74/461; 271/273, 274; 101/232–234, 407, 269; 400/55–60

[56] References Cited

U.S. PATENT DOCUMENTS

| | | | |
|---|---|---|---|
| 356,228 | 1/1887 | Laass et al. | 101/234 |
| 356,406 | 1/1887 | Hey et al. | 101/234 |
| 520,698 | 5/1894 | McElrath | 101/234 |
| 1,060,276 | 4/1913 | Moore | 271/274 |
| 2,017,139 | 10/1935 | Wood | 74/461 |
| 3,618,934 | 11/1971 | Germuska | 271/274 |
| 4,227,819 | 10/1980 | Manriquez | 400/56 |
| 4,279,413 | 7/1981 | Siwik et al. | 271/274 |
| 4,346,883 | 8/1982 | Speraggi | 271/274 |
| 4,358,103 | 11/1982 | Koike et al. | 271/274 |

FOREIGN PATENT DOCUMENTS

| | | | |
|---|---|---|---|
| 54-104164 | 8/1979 | Japan | 271/274 |
| 55-111281 | 8/1980 | Japan | 400/56 |

*Primary Examiner*—William Pieprz

*Attorney, Agent, or Firm*—Sughrue, Mion, Zinn, Macpeak and Seas

[57] ABSTRACT

The mechanism allows a document of various thicknesses and indeed variable thickness to be franked. Said mechanism includes a frame (11) which supports a pressure roll (5) and a lower feed roll (4) and urged towards the chassis by means of three springs (14) so as to allow the shafts of said rolls (4) and (5) to move in any direction.

3 Claims, 6 Drawing Figures

DRIVE AND PRINTING MECHANISM FOR A FRANKING MACHINE

The present invention relates to a drive and printing mechanism for a document franking machine and in particular to a typographic type printing device which prints by means of a rotary printing cylinder, the document to be printed passing through the device.

BACKGROUND OF THE INVENTION

A conventional printing device is constituted, for some types of franking machines, by a cylinder bearing printable characters engraved in relief on its periphery. Said cylinder rotates on its shaft when printing movement is ordered. During the first part of its rotation, the characters pass in front of an inking device which deposits a layer of ink on their upstanding surfaces.

Actual printing takes place when the characters covered in ink come into contact with the document to be printed. Said contact is provided and its pressure controlled by a pressure roll which presses the document against the printing cylinder and simultaneously serves to move the document to be printed.

The devices which feed the documents to the printer and which provide the contact pressure are generally constituted by rubber rolls or conveyor belts.

These rolls or conveyor belts are held in position by mechanical components which position them in space relative to the printing cylinder, in particular, whose shaft is stationary. To frank documents of any thickness, these mechanical supports must allow the rolls or conveyor belts to move away a distance equal to the thickness of the document while keeping the contact pressure constant. Up till now, the contact pressure on the printing cylinder has been adjusted by imparting to the pressure roll a movement which is only parallel to the printing cylinder.

Further, these rolls or belts must also feed the documents into the franking machine and consequently they must be made to rotate by a drive unit.

Said drive function is therefore complicated by the thickness corrector function since a rotary movement must be provided for a unit whose shaft is free to rotate.

Further, the documents to be printed not only vary in thickness from one to another but may also have poor uniformity of thickness and in particular be thicker at one end than at the other.

Such types of defect are not usually properly corrected in franking machines and lead to a printing contact pressure against the characters which is higher at one end of the cylinder than at the other. It follows that the characters make a greater impression where the pressure is highest.

Preferred embodiments of the present invention remedy these drawbacks. Indeed, they make it possible to define a device which takes into account all the requirements for performing the functions necessary for feeding documents to be printed into a franking machine and for generating printing pressure, in particular:

- feeding the documents into the franking machine at the right speed;
- automatic adaptation to variation in thickness;
- automatic adaptation to uneven thickness; and
- creation and maintenance of a constant printing pressure.

SUMMARY OF THE INVENTION

The present invention provides a drive and printing mechanism for a document franking machine, said mechanism comprising a stationary chassis, a printing cylinder with printing characters thereon mounted on the stationary chassis, a pressure roll for co-operating with the printing cylinder, said pressure roll being mounted on a first shaft together with a first toothed ring, a drive gear wheel mounted on a shaft which is mounted on said stationary chassis, upper and lower cooperating document feed rolls, the lower feed roll being mounted on a second shaft together with a second toothed ring, said drive gear wheel being placed to drive both said first and second toothed rings, wherein said first and second shafts are mounted on a single common frame capable of both pitching and rolling movements and being drawn towards the stationary chassis by three spring means whereby said first shafts is free to move in a any direction in a vertical plane and said second shaft is free to move in any direction.

Preferably said chassis has two guide slots to guide said first shaft so as to allow it to move in a vertical plane.

Preferably said gear on a stationary shaft is made of an elastomer.

Advantageously the teeth of said first and second rings are narrow, their width being equal to less than a tenth of the diameter of their respective rings.

BRIEF DESCRIPTION OF THE DRAWINGS

An embodiment of the invention is described by way of example with reference to the accompanying drawings, in which:

FIG. 2 is the same elevation while a thick document is being printed on.

MORE DETAILED DESCRIPTION

Figure 1:
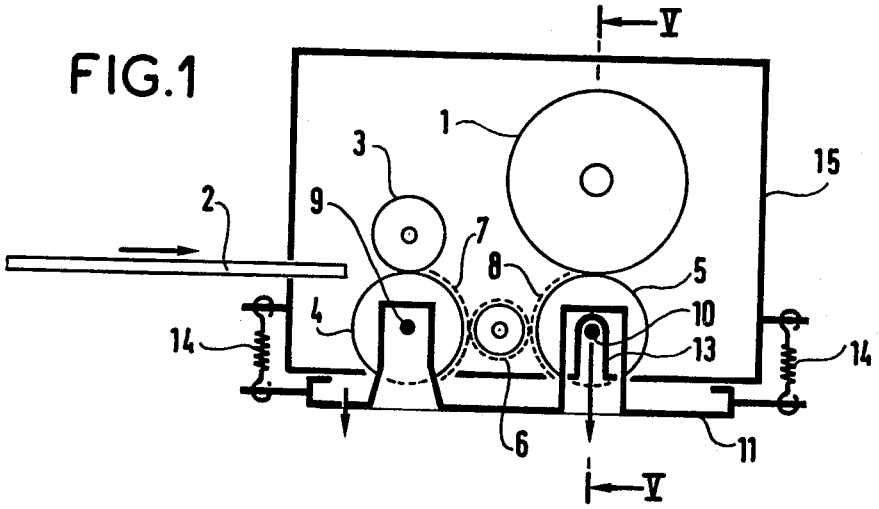
FIG. 1 is a schematic elevation of the rolls before insertion of a document therein.

FIG. 1 shows the main components of a franking machine in accordance with the invention, and a document 2 to be franked. The franking machine comprises a printing cylinder 1, an upper feed roll 3 and mounted on fixed chassis, and a lower feed roll 4, and a lower pressure roll 5 mounted on a moving frame. The components are disposed facing a point where the document 2 to be franked is inserted into the franking machine.

Figure 2:
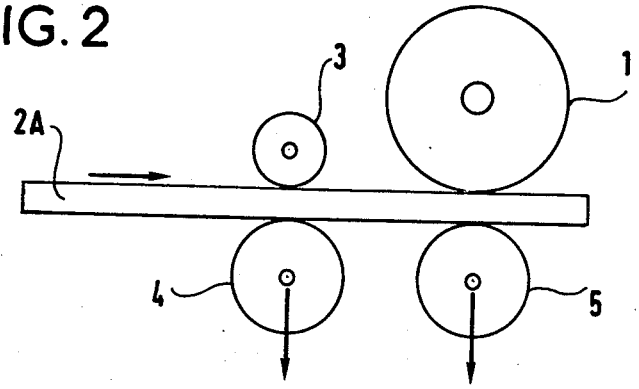

FIG. 2 illustrates the same franking machine printed on a thick document 2A.

Figure 3:
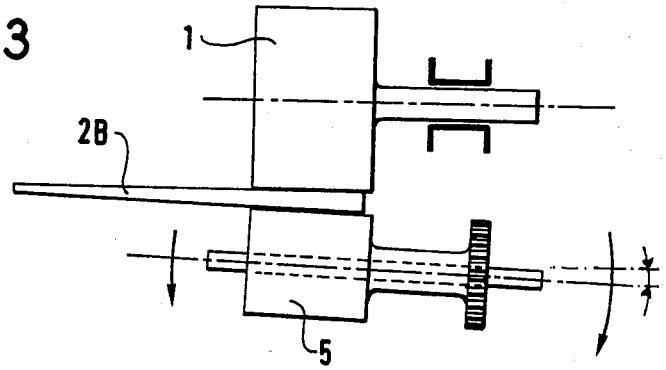
FIG. 3 is a schematic side view of the rolls in the case of a document of variable thickness.

FIG. 3 is a side view of the same machine showing printing on a document of uneven thickness.

Figure 4:
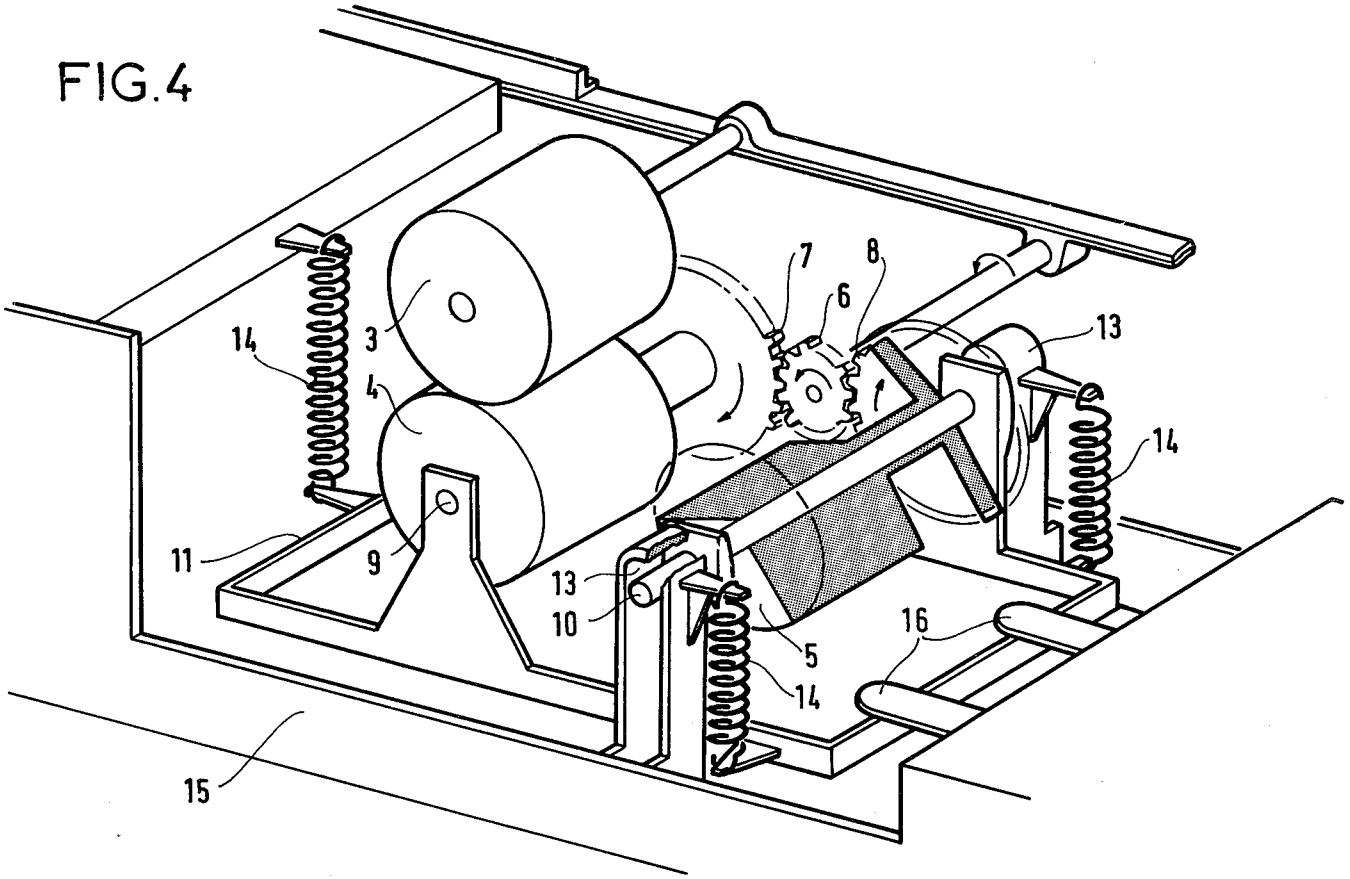
FIG. 4 is a schematic perspective illustration of the mechanism as a whole.

The printing machine and its operation are described below with reference to FIGS. 4 to 6.

A gear wheel 6 is a drive input gear mounted on a shaft which is fixed to the chassis.

It communicates rotational movement to two toothed rings 7 and 8 on respective ones of the rolls 4 and 5.

The rolls rotate on shafts 9 and 10 respectively which are supported by a rigid frame 11.

The frame is guided in vertical movement by engaging the ends of the shaft 10 through vertically extending slots 13 in columns which are fixed to the chassis 15 of the franking machine.

The frame 11 is permanently urged upwards by the traction of three springs 14 whose other ends are fixed to the chassis 15 of the machine.

When no document to be printed is engaged between the feed rolls or between the cylinder and the pressure roll, said frame bears against stops 16 which are integral with the chassis 15.

Printing pressure is supplied when the document passes between the cylinder and the pressure roll. The stops are adjusted so that the thinnest document just moves the frame off the stops. In this way, the springs 14 grip the document between the cylinder and the pressure roller.

The thickness of the documents is automatically compensated by the general downward movement of the frame which is guided by the ends of the shaft 10 engaging in the slots 13 of the chassis 15.

Figure 5:
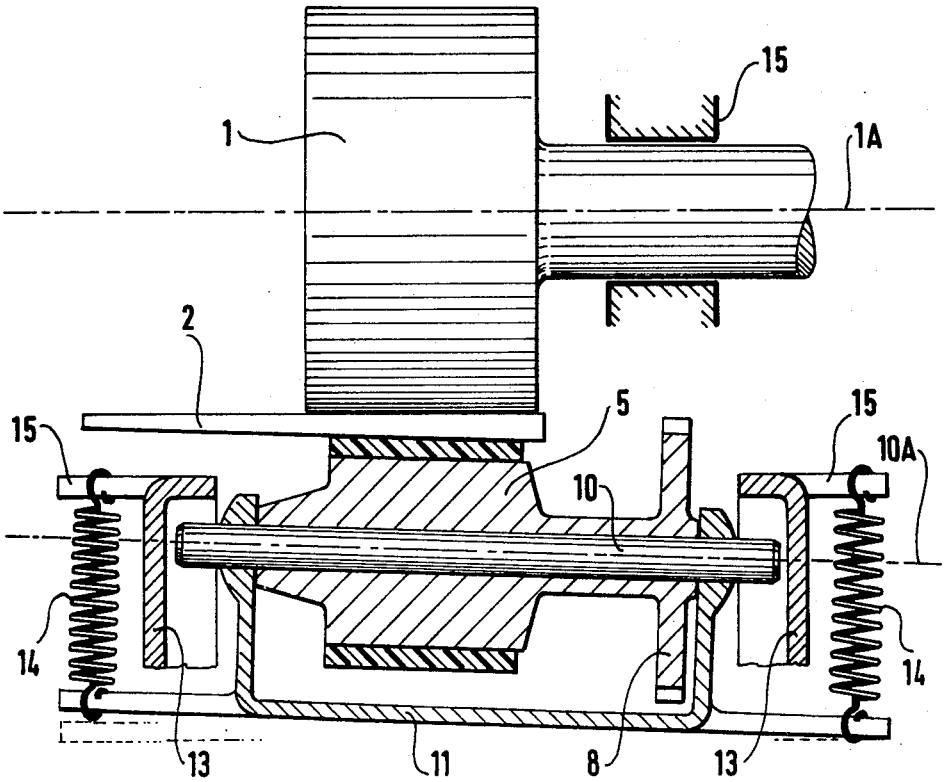
FIG. 5 is a schematic end view of the mechanism as a whole in the case of a document of variable thickness.

Lack of uniformity in thickness is compensated by the fact that it is possible for the frame to be inclined by a document of uneven thickness as shown in FIG. 5 in which the axis 1A of the printing cylinder 1 is not parallel to the axis 10A of the shaft 10.

These two functions cause the gears 6, 7 and 8 to operate under unusual conditions.

Compensating the thickness of the documents requires an increase in the distance between the axes of the gears. Therefore, the shape of the gears is determined so that they operate without play at the shortest distance between the axes.

However, meshing when the distance between axes increases remains correct especially in the case of gears shaped like an involute of a circle, only operating play is increased.

Figure 6:
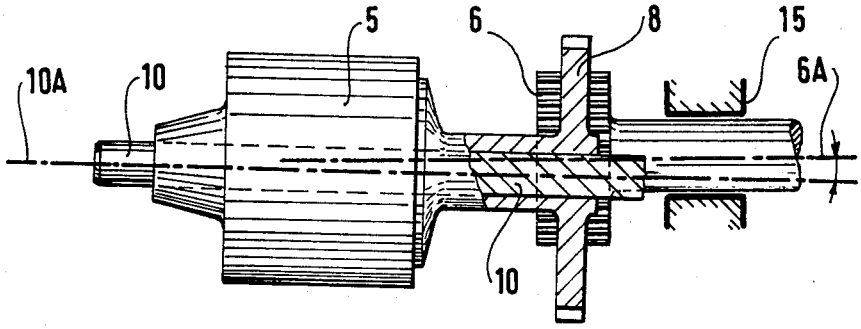
FIG. 6 is a schematic view of a roll in the case of a document of variable thickness.

The compensation of the lack of evenness in thickness causes the axes 6A and 10A of the two gears 6 and 8 not to be parallel as shown in FIG. 6. Likewise, the shafts, not illustrated, of the gears 6 and 7 are not parallel to each other.

Theoretically, operation is impossible under such conditions. However, precautions can be taken to make safe operation possible:

(1) The teeth of each of the rings 7 and 8 must be narrow, e.g. must be equal to less than one tenth of the diameter of the ring. This condition limits predictable interference.

(2) At least one member of the drive chain comprising the gear wheel 6 and the two rings 7 and 8, preferably the drive gear 6, should made of a resilient substance, e.g. a thermoplastic elastomer capable of having its teeth deformed. Interference will be absorbed by the resilient elastomer.

The result of this is that the frame 11 is attracted towards the chassis 15 of the machine by the three springs 14 and thereby allows a pitching movement and rolling movement by virtue of the manner in which it supports the rolls 4 and 5. Said rocking movements could cause the springs to move in any way under the influence of any document. However, the movement of the roll 5 and of its shaft 10 is limited in the vertical plane due to the fact that they are guided by the slots 13.

I claim:

1. A drive and printing mechanism for a document franking machine, said mechanism comprising: a stationary chassis, a printing cylinder with printing characters on its periphery, means for mounting said printing cylinder on the stationary chassis for rotation about a fixed horizontal axis, a pressure roll for co-operating with the printing cylinder, said pressure roll being mounted on a first shaft together with a first toothed ring, a drive gear wheel on a horizontal shaft mounted for rotation on said stationary chassis, upper and lower co-operating document feed rolls, the lower feed roll being mounted on a second shaft together with a second toothed ring, said drive gear wheel being in mesh with said first and second toothed rings to drive said pressure roll and said lower feed roll, the improvement comprising means for mounting said first and second shafts on a single common frame underlying said chassis, spring biasing means for drawing said frame towards the stationary chassis, said single common frame comprising a rectangular frame member, and said spring biasing means comprising three springs including two springs fixed at one end to opposite sides of said rectangular frame member at one end thereof and a third spring fixedly mounted to the center of said rectangular frame member at its opposite end, with said first and second springs being proximate to said first shaft and said third spring being remote therefrom and on the opposite side of said second shaft, and said chassis including two narrow guide slots on opposite sides thereof and receiving said first shaft so as to limit movement of said first shaft in a vertical plane; whereby, via said three spring coupling, both said pressure roll and said lower feed roll may tilt in the vertical plane of movement of their axes to readily compensate for documents of uneven thickness over their width transverse to their directiion of movement in passing through the drive and printing mechanism.

2. A mechanism according to claim 1, wherein said gear on a stationary shaft is made of an elastomer.

3. A mechanism according to claim 1, wherein the teeth of said first and second rings are narrow, their width being equal to less than a tenth of the diameter of their respective rings.

* * * * *